United States Patent [19]

Amitay

[11] Patent Number: 4,458,247

[45] Date of Patent: Jul. 3, 1984

[54] PHASED ARRAY ANTENNA EMPLOYING LINEAR SCAN FOR WIDE ANGLE ORBITAL ARC COVERAGE

[75] Inventor: Noach Amitay, Tinton Falls, N.J.

[73] Assignee: Bell Telephone Laboratories, Incorporated, Murray Hill, N.J.

[21] Appl. No.: 272,750

[22] Filed: Jun. 11, 1981

[51] Int. Cl.[3] ..... H01Q 3/22; H01Q 3/24; H01Q 3/26

[52] U.S. Cl. ..... 343/368

[58] Field of Search ..... 343/100 AD, 100 ST, 343/100 SA, 824, 854, 7.4, 100 CS, 112 C, 112 R

[56] References Cited

U.S. PATENT DOCUMENTS

| | | | |
|---|---|---|---|
| 2,245,660 | 6/1941 | Feldman et al. | 343/100 SA |
| 3,349,398 | 10/1967 | Werth | 343/100 ST |
| 3,806,930 | 4/1974 | Gobert | 343/100 SA |
| 3,836,970 | 9/1974 | Reitzig | 343/100 ST |
| 3,852,763 | 12/1974 | Kreutel et al. | 343/100 ST |

OTHER PUBLICATIONS

Skolnik, M. I., Introduction to Radar Systems, McGraw-Hill Book Co., N.Y., 1962, Sec. 7.7, (pp. 294 thru 320).

Skolnik, M. I., Radar Handbook, McGraw-Hill Book Co., N.Y., 1970, pp. 11-1 thru 11-21 and 32-1 thru 32-32.

*Primary Examiner*—Theodore M. Blum

*Attorney, Agent, or Firm*—Erwin W. Pfeifle

[57] ABSTRACT

The present invention relates to a technique for enabling an antenna system to linearly scan over a wide angle of an orbital arc segment from a terrestrial ground station to access or track satellites within the segment. The wide angle linear scan capability is achieved by orienting the antenna system at the ground station relative to the local terrestrial coordinate system such that the axis normal to the aperture plane of the antenna system is at a predetermined angle and lies in a plane substantially parallel to the plane of the orbital arc segment. Then, by squinting the beam toward the orbital arc segment by applying a fixed linear phase taper to the antenna elements of a planar phased array along one axis of the array, linear scanning of the orbital arc segment is possible by, for example, varying the linear phase taper applied to antenna elements along another axis of the array.

4 Claims, 8 Drawing Figures

PHASED ARRAY ANTENNA EMPLOYING LINEAR SCAN FOR WIDE ANGLE ORBITAL ARC COVERAGE

BACKGROUND OF THE INVENTION

1. Field of the Invention

The present invention relates to a technique for enabling phased array antenna systems to linearly scan over a wide angle of an orbital arc segment from a terrestrial ground station to access or track satellites within the segment and, more particularly, to a technique for providing wide angle linear scan capability by orienting the phased array antenna system in a predetermined manner relative to the local terrestrial coordinate system and then squinting the beam towards the orbital arc segment.

2. Description of the Prior Art

With high capacity satellite communication systems as with subscription program satellite systems vendors or users, ground stations may wish to communicate with two or more satellites positioned at different locations along the Geosynchronous Equatorial Arc (GEA). At present, a separate ground station antenna would be used to communicate with each satellite of the system making ground stations more complex and costly. A single antenna that can track or simultaneously or sequentially communicate with all satellites of interest could circumvent the above problems.

Movable antennas of the type disclosed in, for example, U.S. Pat. Nos. 3,836,969 issued to D. S. Bond et al on Sept. 17, 1974 and 3,945,015 issued to M. Gueguen on Mar. 16, 1976 could be used for tracking purposes or for communicating with one or more satellites, but such type antennas are not useful when fast switching between multiple satellites is required. Multibeam reflector antennas using separate feedhorns as disclosed, for example, in U.S. Pat. Nos. 3,914,768 issued to E. A. Ohm on Oct. 21, 1975 and 4,145,695 issued to M. J. Gans on Mar. 20, 1979 or using phased arrays as disclosed, for example, in U.S. Pat. Nos. 3,340,531 issued to G. P. Kefalas et al on Sept. 5, 1967 and 3,806,930 issued to J. F. Gobert on Apr. 23, 1974 have also been suggested for satellite ground stations. In some of such type antennas, oversized reflectors may be required while the scanning capability of others may be limited by excessive gain loss. With some of the specially designed and aberration correcting multireflector antennas with multiple feeds for a 0.5 degree beamwidth and 45 degrees of GEA coverage, a ±45 beamwidth scan capability is required. Such severe requirement introduces an antenna gain loss of 1 dB or more due to phase aberrations, as well as imposing a cumbersome antenna structure.

The problem, therefore, remaining in the prior art is to provide an antenna having wide angle scan capabilities which circumvents the gain loss experienced by prior art antennas while simplifying the antenna structure.

SUMMARY OF THE INVENTION

The foregoing problems have been solved in accordance with the present invention which relates to a technique for enabling phased array antenna systems to linearly scan over a wide angle of an orbital arc segment from a terrestrial ground station to access or track satellites within the segment and, more particularly, to a technique for providing wide angle linear scan capabilities by orienting the phased array antenna system in a predetermined manner relative to the local terrestrial coordinate system and then squinting the beam towards the orbital arc segment.

It is an aspect of the present invention to provide wide angle linear scan capabilities for a phased array antenna system of an orbital segment by orienting the phased array at the ground station relative to the local terrestrial coordinate system such that the axis normal to the aperture plane of the antenna system is at a predetermined angle and substantially parallel to the plane of the orbital arc segment. Then, by squinting the beam toward the orbital arc segment using fixed phase shifts applied to the linear segments along one axis of the array, the linear scanning of the orbital arc segment is achieved by varying the linear phase taper applied to antenna elements along the other orthogonal axis of the array.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The present invention is described hereinafter as a technique for the wide angle linear scanning of a segment of the Geosynchronous Equatorial Arc (GEA) using a multibeam array antenna comprising properly phased elements. It is to be understood that such description is merely for purposes of expositions and not for purposes of limitation since the present technique could similarly be used for linearly scanning or tracking one or more satellites disposed in any orbital arc segment once the antenna has been properly oriented as described hereinafter in relation to the orbital arc segment of interest. Additionally any linear scanning antenna which can be squinted as described hereinafter towards the orbital arc segment of interest can be used for the multibeam array antenna described.

Figure 1:
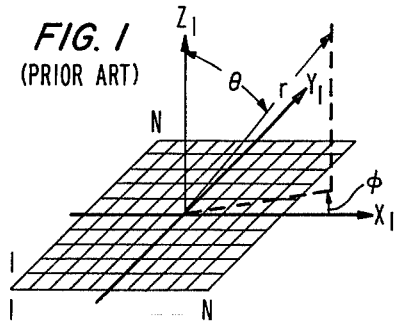
FIG. 1 (PRIOR ART)
FIG. 1 illustrates a known N×N planar array of feed elements.

A planar array of N×N elements shown in FIG. 1 with two dimensional scan capability usually requires $N^2$ phase shifters. For example, for a 30 degree scan capability from broadside, 0.5 degree beamwidth, and no visible grating lobes, many tens of thousands of array elements, with their associated phase shifters and amplifiers, are required per beam. On the other hand, only N phase shifters and amplifiers per beam would be needed for a one dimensional linear scan. Thus, there is a big economic advantage to utilizing a linear scan at a ground station for scanning or tracking one or more stationary or moving satellites in, for example, the Geosynchronous Equatorial Arc. The discussion of linear scan hereinafter does not necessarily imply that the beams will be scanned in, for example, a communication system. Such discussion also pertains to the feasibility of widely spaced fixed narrow beams without gain loss due to phase aberrations.

Figure 2:
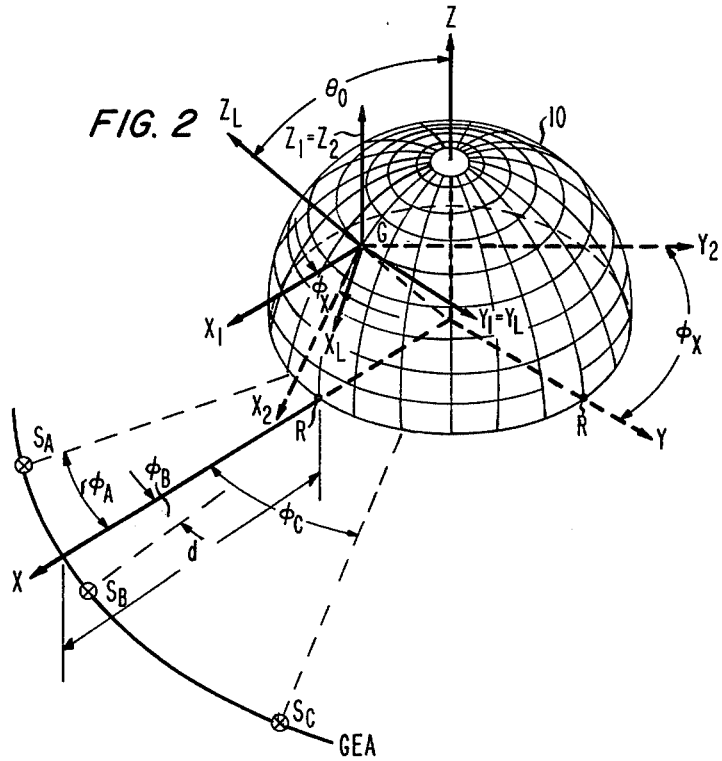
FIG. 2 illustrates the hemisphere of a celestial body including a ground station and three satellites in a Geosynchronous Equatorial Arc (GEA) segment and a first orientation of the antenna towards achieving a final orientation which will allow a linear scan of the GEA segment.

To provide an understanding of the present invention, FIG. 2 shows a hemisphere of a celestial body 10 having a radius R which is divided at its equator. A ground station G associated with a communication system is disposed on the surface of celestial body 10 at a predetermined latitude and longitude. The celestial body coordinates are represented by a polar axis Z, an X axis which intersects the meridian of the ground station G and a Y axis. Three satellites $S_A$, $S_B$ and $S_C$ associated with the communication system are depicted in orbit on a segment of the GEA about celestial body 10 at a distance d from the equator and at the azimuth angles $\phi_A$, $\phi_B$ and $\phi_C$, respectively, from the celestial body coordinate axis X within the view of ground station G.

To communicate with the satellites $S_A$, $S_B$ and $S_C$, independent beam forming systems (one per satellite) at the ground station will combine (split) and transmit (receive) the appropriate signals, after proper amplification, via a single array antenna. A linear scan can be utilized for a multisatellite system when the satellite locations lie in cardinal planes of the array directional cosine coordinate system shown in FIG. 3. The directional cosine coordinate system of FIG. 3 can be easily derived from FIG. 1 using well known mathematical principles, e.g., $T_X=\sin\theta\cos\phi$ and $T_Y=\sin\theta\sin\phi$, and $T_X=0$ and $T_Y=0$ are the cardinal planes. It is clear that when only two satellites in the GEA are involved, one can always position the ground station antenna such that these satellites lie in one of its cardinal planes. For three or more satellites, however, the situation is not as simple.

In the case of 3 satellites, it is possible to orient the antenna such that two satellites lie in one cardinal plane while the third satellite lies in the other cardinal plane. For such orientation, the antenna would probably require a planar array of more than 30,000 elements for the conditions described hereinbefore, with its associated beam forming systems. For beams falling in one cardinal plane, the elements, for example, in each column would not be phased while appropriate phasing would be applied between columns. For beams falling in the orthogonal cardinal plane, the elements in each row would not be phased while appropriate phasing would be applied between rows. This requires summing/splitting and multiplexing networks at the individual array element level, making the antenna system more cumbersome and lossier. In addition, a change in the GEA location of one of the satellites will require a reorientation of the array as well as modifications of all the beam forming systems. An optimum mapping of a 60 degree GEA segment onto a cardinal plane, $T_x=0$, for a ground station located at 35 degrees latitude has shown a maximum deviation of the 60 degree GEA segment from $T_x=0$ as about 0.008 which corresponds to an angle of 0.46 degrees. For narrow beam antennas, this high a deviation precludes the utilization of a linear scan in the cardinal plane.

Figure 3:
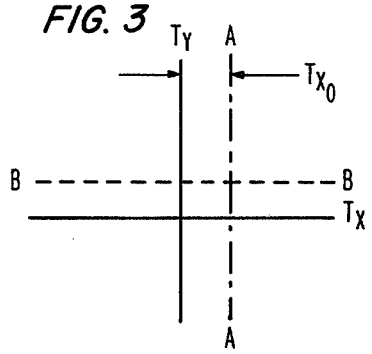
FIG. 3 illustrates the directional cosine coordinate system of the array of FIG. 1.
Figure 4:
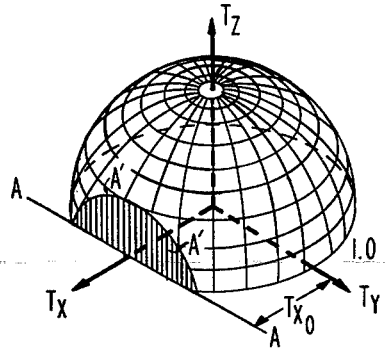
FIG. 4 illustrates the projection of a $T_x$=constant surface in the directional cosine coordinate system of FIG. 3 on a unit hemisphere.

In accordance with the present invention, one dimensional or linear scanning can be used when the desired segment of the GEA lies very close to a plane parallel to a cardinal plane in the $T_x$-$T_y$ coordinates of the array as represented by either one of planes A—A or B—B in FIG. 3. If a unit radius hemisphere were placed on the directional cosine coordinate system of FIG. 3, it should be emphasized that a $T_x$=constant plane in the $T_x$-$T_y$ coordinates, A—A, corresponds to an arc A'—A' on the hemisphere as shown in FIG. 4. For $T_x=0$, the cardinal plane, such arc lies in the $T_y-T_z$ plane. As the maximum of an antenna beam is linearly scanned along A—A in FIG. 3, the corresponding beam maximum will move along the circular arc A'—A' in FIG. 4. Such linear scan can be accomplished in the antenna of FIG. 1 by applying a fixed linear phase taper within each row, for example, to offset or squint the beam by an amount $T_{x0}$ while applying a variable linear phase taper between the rows to scan the beam along arc A'—A' in FIG. 4.

When the ground station is on the equator, the GEA can be mapped onto one of the antenna cardinal planes and when the ground station is at the north or south poles, the GEA can be mapped onto a plane in the $T_x$-$T_y$ coordinates parallel to a cardinal plane. For in-between latitudes of the ground stations antennas, one can only approximately map a segment of the GEA onto a parallel to a cardinal plane.

An exemplary coordinate transformation for orienting the antenna so as to optimally align the arc A'—A' in FIG. 4 with the GEA segment will now be presented. This optimum is a function of the ground station latitude and its longitude location relative to the GEA segment. It will be found that a 60 degree GEA segment can be mapped onto a parallel to a cardinal plane to within few thousandths of a degree for latitudes of, for example, 0 degrees to at least 50 degrees. This facilitates the use of a linear scan for very narrow multibeam array antennas. Even if the orbital location of a given satellite has to be changed, only a modification of the beam forming system is required with no mechanical reorientation of the antenna since the beam will track the GEA arc segment and all satellites located in that segment.

Figure 5:
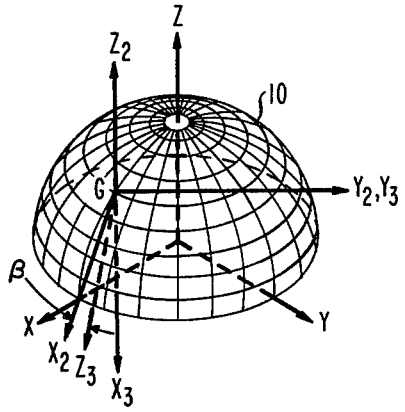
FIG. 5 illustrates a second orientation of the antenna after the orientation of FIG. 2 towards achieving a final orientation in accordance with the present invention which will allow a linear scan of the GEA segment.
Figure 6:
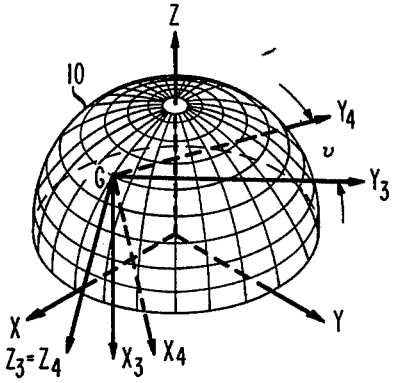
FIG. 6 illustrates a third orientation of the antenna after the orientation of FIG. 5 which achieves the proper final orientation in accordance with the present invention that allows a linear scan of the GEA segment using a squinted beam.

In general, the wide angle linear scan capability is achieved in accordance with the present invention by orienting the phased array antenna at the ground station relative to the terrestrial surface coordinate system, where the terrestrial surface coordinate system is a translation of the celestial body coordinate system X, Y, Z to the location of the ground station on the surface of the celestial body, such that after the rotations of the coordinate systems as shown in FIGS. 2, 5 and 6, the axis, $Z_4$, normal to the aperture plane of the antenna system is both at a predetermined angle to cause said axis to transit the orbital arc segment of interest near the center thereof, and substantially parallel to the plane of the orbital arc segment to be linearly scanned. Then, by squinting the beam from the antenna system at the orbital arc segment using, for example, fixed phase shifts or predetermined time delays to linear segments along one axis of the array, the linear scanning of the orbital arc segment is achieved by varying the linear phase taper to antenna elements along the other orthogonal axis of the array.

Figure 7:
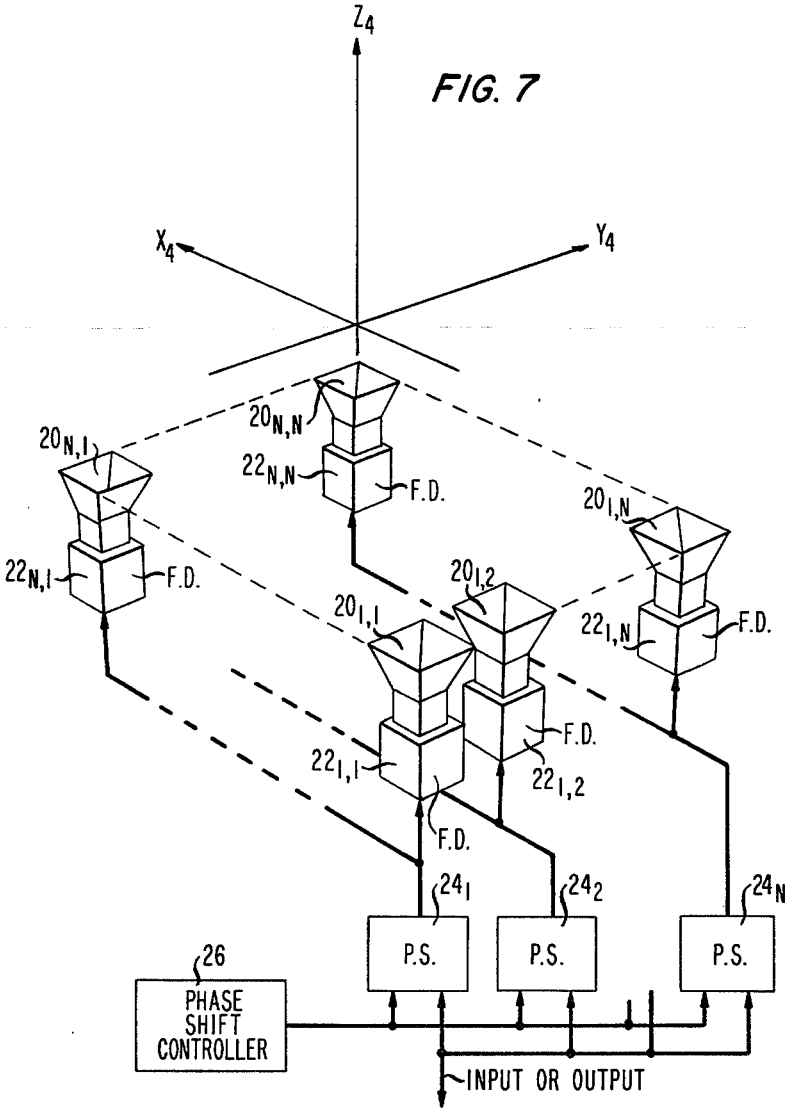
FIG. 7 illustrates a N×N planar array of feed elements which provide a squinted beam for linear scanning of a GEA segment.

A typical planar phased array for performing such linear scan is shown in FIG. 7 comprising an N×N array of elements 20 with elements $\mathbf{20}_{1,1}$ to $\mathbf{20}_{1,N}$ forming the first row along the $X_4$ axis and elements $\mathbf{20}_{N,1}$ to $\mathbf{20}_{N,N}$ forming the $N^{th}$ row. Each array element is coupled to a separate fixed delay (or phase shift) means 22 which provides a predetermined fixed delay (or phase shift) to the signal passing therethrough to or from the associated array element 20. As shown in FIG. 7, fixed delay means $\mathbf{22}_{1,1}$ is connected to element $\mathbf{20}_{1,1}$ fixed delay means $\mathbf{22}_{1,N}$ is connected to element $\mathbf{20}_{1,N}$ and similarly fixed delay means $\mathbf{22}_{N,1}$ and $\mathbf{22}_{N,N}$ are connected to elements $\mathbf{20}_{N,1}$ and $\mathbf{20}_{N,N}$, respectively. Each of the fixed delay means in a particular row introduces the same amount of delay into the signals passing therethrough, which delay is slightly different from delays introduced by the fixed delay means 22 associated with the other rows to produce a fixed linear phase taper or delay across the fixed delay means 22 of each column. In this manner the necessary squint of a beam towards the orbital arc segment of interest is produced once the $Z_4$ axis of the array is properly oriented with respect to the local terrestrial coordinate system.

The fixed delay means $\mathbf{22}_{1,1}$–$\mathbf{22}_{N,1}$ to $\mathbf{22}_{1,N}$–$\mathbf{22}_{N,N}$ in each column of the array arc connected to a separate phase shifter $\mathbf{24}_1$–$\mathbf{24}_N$, respectively, which phase shifters $\mathbf{24}_1$–$\mathbf{24}_N$ are, in turn, connected to a common input or output lead associated with an antenna user circuit as, for example, a transmitter or receiver. Each of phase shifters $\mathbf{24}_1$–$\mathbf{24}_N$ are responsive to control signals from a phase shift controller 26 for introducing a predetermined linear phase taper into the signals propagating to or from the associated elements of each of the columns of the array. The same linear phase taper is introduced across each of the columns of elements 20 to provide a predetermined directional beam. Therefore, the fixed delay means 22 causes the beams of the antenna, on transmission, to be directed with a fixed predetermined squint while phase shift controller 26 can cause phase shifters $\mathbf{24}_1$–$\mathbf{24}_N$ to introduce changeable linear phase tapers across the columns of elements 20 to produce beam movement in a predetermined manner over the arc segment A′—A′ in FIG. 4 in the far field of the antenna. Elements 20, 22, 24 and 26 are well known in the art and any suitable device for performing the functions described above can be used. For example, phase shift controller 26 can comprise a microprocessor and associated memory for storing a scan sequence of control signals which can be accessed sequentially or can comprise a similar arrangement as shown in U.S. Pat. No. 3,978,482 issued to F. C. Williams et al on Aug. 31, 1976. It should be understood that the set of phase shifters 24 in FIG. 7 are used for transmitting or receiving one beam. For transmitting or receiving another beam, a separate set of phase shifters 24 coupled to a second input or output would be multiplexed to the set of phase shifters 24 of FIG. 7 as is well known in the art.

One technique for optimally aligning the arc A′—A′ shown in FIG. 4 with the GEA arc segment of interest is to provide appropriate coordinate transformation and rotations as will now be described for the mapping of the GEA segment onto a plane parallel to a cardinal plane. Such situation is more desirable than the mapping of three satellites in the two array cardinal planes since the only limitation on the number of satellites that can be covered depends on the minimum intersatellite spacing. In the following transformation and rotations the mean square deviation of the GEA segment is minimized from a plane parallel to a cardinal plane in the $T_X$-$T_Y$ directional cosine coordinates of the array. It is to be understood that there are other various optimization approaches available, e.g., minimax, peak absolute error, etc. The mean square deviation approach used here is the most tractable and produces excellent results.

In accordance with the present technique, and in accordance with well known mathematical techniques for transforming or rotating coordinates, the celestial body polar coordinate system is first translated to the ground station location G. This is shown in FIG. 2 by the translation of the X, Y, Z celestial body coordinate system to the $X_1$, $Y_1$, $Z_1$ terrestrial surface coordinate system at ground station G. Three coordinate rotations are next performed by the angles $\phi_X$ in FIG. 2, $-(\pi/2+\beta)$ in FIG. 5 and $\nu$ in FIG. 6 about the $Z_1$, $Y_2$ and $Z_3$ axis, respectively. Also shown in FIG. 2 is a local coordinate system at ground station G comprising the $X_L$, $Y_L$ and $Z_L$ axes, which local coordinate system is a rotation of the terrestrial surface coordinate system around the $Y_1$ axis such that the new $Z_1$ axis, designated $Z_L$, becomes aligned with a line intersecting ground station G and the center of the celestial body polar coordinate system. The axis $Z_L$ is disposed at an angle $\theta_0$ from the celestial body polar axis Z.

More particularly, as shown in FIG. 2, ground station G is located at $X_0=R\sin\theta_0$; $Y_0=0$; $Z_0=R\cos\theta_0$. The three satellites in GEA are $S_A$, $S_B$, and $S_C$ located at $(R+d;\theta_{GEA}=\pi/2;\phi_A)$, $(R+d;\pi/2;\phi_B)$, and $(R+d;\pi/2;\phi_C)$, respectively, where $\theta_{GEA}$ is the angle from the celestial body polar coordinate axis Z to the GEA. The origin X, Y, Z axes are translated to the ground station location to generate the resultant terrestrial surface coordinate system ($X_1$, $Y_1$, $Z_1$) which can be defined, using well known mathematical principles as:

$$\begin{aligned} X &= X_0 + X_1; & X_1 &= X - X_0 \\ Y &= Y_1 \quad ; & Y_1 &= Y \\ Z &= Z_0 + Z_1; & Z_1 &= Z - Z_0. \end{aligned} \tag{1}$$

As shown in FIG. 2, the $X_1$, $Y_1$, $Z_1$ terrestrial surface coordinate system is then rotated about the $Z_1$ axis by an angle $\phi_X$ to generate the $X_2$, $Y_2$, $Z_2$ axes which can be defined by $$\begin{aligned} X_1 &= X_2\cos\phi_X - Y_2\sin\phi_X; & X_2 &= X_1\cos\phi_X + Y_1\sin\phi_X \\ Y_1 &= X_2\sin\phi_X + Y_2\cos\phi_X; & Y_2 &= -X_1\sin\phi_X + Y_1\cos\phi_X \\ Z_1 &= Z_2 \quad ; & Z_2 &= Z_1. \end{aligned} \tag{2}$$

The angle $\phi_X$ is chosen initially as $$\phi_X = \frac{\phi_A + \phi_C}{2}$$

which is the mid point of the GEA arc segment of interest to minimize the antenna gain loss due to reduction of the projected aperture.

As shown in FIG. 5, the $X_2$, $Y_2$, $Z_2$ axes are next rotated around the $Y_2$ axis by an angle $-(\pi/2+\beta)$ to bring the ground station antenna $Z_2$ axis to the vicinity of the GEA and generate the $X_3$, $Y_3$ and $Z_3$ axes as defined by:

$$\begin{aligned} X_2 &= -X_3\sin\beta + Z_3\cos\beta; & X_3 &= -X_2\sin\beta - Z_2\cos\beta \\ Y_2 &= Y_3 \quad ; & Y_3 &= Y_2 \\ Z_2 &= -X_3\cos\beta - Z_3\sin\beta; & Z_3 &= X_2\cos\beta - Z_2\sin\beta. \end{aligned} \tag{3}$$

Finally the $X_3$, $Y_3$, and $Z_3$ axes are rotated about the $Z_3$ axis by an angle $\nu$ as shown in FIG. 6 to obtain the $X_4$, $Y_4$ and $Z_4$ axes defined by:

$$\begin{aligned} X_4 &= X_3\cos\nu + Y_3\sin\nu = -(X_2\sin\beta + Z_2\cos\beta)\cos\nu + Y_2\sin\nu \\ Y_4 &= -X_3\sin\nu + Y_3\cos\nu = (X_2\sin\beta + Z_2\cos\beta)\sin\nu + Y_2\cos\nu \\ Z_4 &= Z_3 = X_2\cos\beta - Z_2\sin\beta. \end{aligned} \tag{4}$$

The directional cosine $T_{X4}$, is given by:

$$T_{X4} = \frac{X_4}{r_4} = \frac{-(X_2\sin\beta + Z_2\cos\beta)\cos\nu + Y_2\sin\nu}{r_4} \tag{5}$$

where $$r_4 = [(X - X_0)^2 + Y^2 + (Z - Z_0)^2]^{\frac{1}{2}} \tag{6}$$

For points on the GEA, from equations (1), (2) and (5) one can obtain the value for $T_{X4}$ as:

$$T_{T4}^{GEA} = \left.\frac{-(X_2\sin\beta + Z_2\cos\beta)\cos\nu + Y_2\sin\nu}{r_4}\right|_{GEA} \tag{7}$$

with $$\begin{aligned} X_2^{GEA} &= (R + d)[\cos\phi_i\cos\phi_x + \sin\phi_i\sin\phi_x] - R\sin\theta_0\cos\phi_x \\ Y_2^{GEA} &= (R + d)[\sin\phi_i\cos\phi_x - \cos\phi_i\sin\phi_x] + R\sin\theta_0\sin\phi_x \\ Z_2^{GEA} &= -R\cos\theta_0 \\ r_4^{GEA} &= [(R + d)^2 + R^2 - 2R(R + d)\sin\theta_0\cos\phi_i]^{\frac{1}{2}} \end{aligned} \tag{8}$$

where $\phi_i$ is the angle relative to the X axis of the celestial body polar coordinate system, as shown in FIG. 2, to any point on the GEA arc segment.

To minimize the square deviation of the $T_{X4}^{GEA}$ from a plane parallel to a cardinal plane over the $(\phi_C-\phi_A)$ segment one can use:

$$I = \int_{\phi_A}^{\phi_C}\left(D - T_{X4}^{GEA}\right)^2 d\phi_i \tag{9}$$

with $$\frac{\partial I}{\partial D} = 0; \frac{\partial I}{\partial \beta} = 0; \frac{\partial I}{\partial \nu} = 0, \tag{10}$$

where $T_{X4}=D$ is the plane, parallel to a cardinal plane, which minimizes the square deviation of $T_{X4}^{GEA}$ over the $\phi_A$ to $\phi_C$ segment. $T_{X4}^{GEA}$ in equation (7) is nonlinear in $\nu$ and $\beta$. However, when $\nu$, $\beta << 1$ the following approximation can be used:

$$\left.\begin{aligned} \sin\beta &\approx \beta; & \cos\beta &\approx 1 \\ \sin\nu &= \nu; & \cos\nu &\approx 1 \end{aligned}\right\} \nu, \beta << 1 \tag{11}$$

Substituting equation (11) in equations (7) and (8) there is obtained:

$$T_{X4}^{GEA} \approx -\frac{\beta X_2^{GEA} - \nu Y_2^{GEA} + Z_2^{GEA}}{r_4^{GEA}} \tag{12}$$

which is linear in $\nu$ and $\beta$.

Equation (9) can now be solved, using standard techniques. Reversing the order of partial differentiation and integration while employing numerical integration one can obtain a set of three linear equations for D, $\beta$, and $\nu$. The solution of these equations yields the sought after values for $\beta$ and $\nu$.

Figure 8:
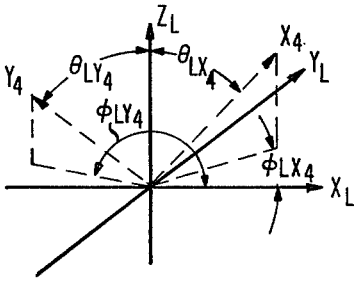
FIG. 8 illustrates the relationship between the local coordinate system and the final coordinate system after rotation of the terrestrial surface coordinate system as shown in FIGS. 2, 5 and 6.

Alternatively, if the angles $\phi_X$, $\beta$, and $\nu$ are known, one can position the aperture plane of the antenna in the $X_4$, $Y_4$ plane in accordance with the relationships:

$$\phi_{LX4} = \tan^{-1}\frac{Y_L(X_4)}{X_L(X_4)}, \quad \phi_{LY4} = \tan^{-1}\frac{Y_L(Y_4)}{X_L(Y_4)},$$

$$\theta_{LX4} = \tan^{-1}\sqrt{\frac{X_L^2(X_4) + Y_L^2(X_4)}{Z_L(X_4)}} \quad \text{and}$$

$$\theta_{LY4} = \tan^{-1}\sqrt{\frac{X_L^2(Y_4) + Y_L^2(Y_4)}{Z_L(Y_4)}}$$

where $\phi_{LX4}$ and $\phi_{LY4}$ are the azimuth angles of the $X_4$ and $Y_4$ axes, respectively, in the local coordinate system, $\theta_{LX4}$ and $\theta_{LY4}$ are the angles of the $X_4$ and $Y_4$ axes, respectively, relative to the $Z_L$ axis of the local coordinate system as shown in FIG. 8, and the local coordinate axes as a function of the $X_4$ and $Y_4$ axes can be defined by:

$$X_L(X_4)=X_4\{-[\cos\nu\sin\beta\cos\phi_X+\sin\nu\sin\phi_X]\cos\theta_0+\cos\nu\cos\beta\sin\theta_0\},$$

$$Y_L(X_4)=X_4\{-\cos\nu\sin\beta\sin\phi_X+\sin\nu\cos\phi_X\},$$

$$Z_L(X_4)=-X_4\{[\cos\nu\sin\beta\cos\phi_X+\sin\nu\sin\phi_X]\sin\phi_0+\cos\nu\cos\beta\cos\theta_0\},$$

$$X_L(Y_4)=Y_4\{[\sin\nu\sin\beta\cos\phi_X-\cos\nu\sin\phi_X]\cos\theta_0-\sin\nu\cos\beta\sin\theta_0\},$$

$$Y_L(Y_4)=Y_4\{\sin\nu\sin\beta\sin\phi_X+\cos\nu\cos\phi_X\},$$

$$Z_L(Y_4)=Y_4\{[\sin\nu\sin\beta\cos\phi_X-\cos\nu\sin\phi_X]\sin\theta_0+\sin\nu\cos\beta\cos\theta_0\}.$$

What is claimed is:

1. A method of permitting a linear scan of an antenna system disposed at a ground station on the surface of the earth to provide wide angle coverage of a predetermined circular or elliptical orbital arc segment around the earth and within the field of view of the ground station characterized in that the method comprises the steps of:

(a) orienting the antenna system in a terrestrial surface coordinate system of the earth comprising a first, second, and third axis ($X_1$, $Y_1$, $Z_1$) at the location of the ground station, where the terrestrial surface coordinate system of the earth is a translation of a polar coordinate system of the earth comprising a first, second and third axis (X, Y, Z), such that the orbital arc segment of interest lies in a predetermined plane substantially parallel to a cardinal plane in a directional cosine coordinate system of the antenna system;

(b) launching an electromagnetic energy beam in response to an input signal to the antenna system which is squinted by a predetermined amount by the antenna system toward the orbital arc segment, the combination of the orientation of the antenna system in step (a) and the amount of squint producing a minimum beam pointing error when scanning the beam over the orbital arc segment; and (c) linearly scanning the antenna system to direct the electromagnetic energy beam in a predetermined manner to different points on the orbital arc segment.

2. The method according to claim 1 wherein the antenna system comprises a planar phased array including a grid of antenna elements disposed in a first and second orthogonal direction along a first and second axis of a planar aperture of the antenna system characterized in that p1 the method comprises the further steps of:

(d) in performing step (b) introducing a separate predetermined fixed linear phase taper to each linear portion in a first direction of the grid of antenna elements to cause the antenna to launch an electromagnetic energy beam in response to an input signal to the antenna system which is squinted by the predetermined amount toward the orbital arc segment; and (e) in performing step (c), introducing a separate predetermined linear phase taper to the antenna elements along each linear portion in a second direction of the grid of antenna element for causing the electromagnetic energy beam to be directed at a predetermined point on the orbital arc segment and to be redirected along the orbital arc segment as the linear phase taper of step (e) is changed.

3. The method according to claim 1 or 2 characterized in that in performing step (a), orienting the antenna system in the terrestrial surface coordinate system of the earth to form a first intermediate coordinate system comprising a first, second and third axis ($X_1$, $Y_1$, $Z_1$) which is aligned with the first, second and third axis, respectively, of the terrestrial surface coordinate system of the earth followed by sequential rotations of (1) the first intermediate coordinate system around its third axis by an angle $\phi_X$ to produce a second intermediate coordinate system comprising a first, second and third axis ($X_2$, $Y_2$, $Z_2$) which directs the first axis thereof to transit near the center of the orbital arc segment, (2) the second intermediate coordinate system around its second axis by an angle $-(\pi/2+\beta)$ to produce a third intermediate coordinate system comprising a first, second and third axis ($X_3$, $Y_3$, $Z_3$) which directs the third axis thereof at a predetermined angle and substantially parallel to the plane of the orbital arc segment, and (3) the third intermediate coordinate system around its third axis by an angle $\nu$ to produce a fourth intermediate coordinate system comprising a first, second and third axis ($X_4$, $Y_4$, $Z_4$), such that a planar phased array of the antenna system comprising a grid of antenna elements disposed in rows and columns along a first and second axis ($X_4$, $Y_4$) of the fourth intermediate coordinate system which is related to a local coordinate system at the ground station in accordance with the relationships:

$$\phi_{LX4} = \tan^{-1}\frac{Y_L(X_4)}{X_L(X_4)}, \quad \phi_{LY4} = \tan^{-1}\frac{Y_L(Y_4)}{X_L(Y_4)},$$

$$\theta_{LX4} = \tan^{-1}\sqrt{\frac{X_L^2(X_4) + Y_L^2(X_4)}{Z_L(X_4)}} \quad \text{and}$$

$$\theta_{LY4} = \tan^{-1}\sqrt{\frac{X_L^2(Y_4) + Y_L^2(Y_4)}{Z_L(Y_4)}}$$

where said local coordinate system comprises a first, second and third axis ($X_L$, $Y_L$, $Z_L$) which is generated by a rotation of the terrestrial surface coordinate system of the earth around its second axis such that the third axis ($Z_L$) is aligned with a line intersecting the ground station location and the center of the earth's polar coordinate system and is disposed at an angle $\theta_0$ from the third axis (Z) of the earth's polar coordinate system, $\phi_{LX4}$ and $\phi_{LY4}$ are the azimuth angles of the first and second axes, respectively, of the fourth intermediate coordinate system, $\theta_{LX4}$ and $\theta_{LY4}$ are the angles of the first and second axes, respectively, of the fourth intermediate coordinate system relative to the third axis ($Z_L$) of the local coordinate system, and the first, second and third axes of the local coordinate system as a function of the first and second axes ($X_4$ and $Y_4$) axes of the fourth intermediate coordinate system are defined by:

$$\{X_L(X_4)=X_4-[\cos\nu\sin\beta\cos\phi_X+\sin\nu\sin\phi_X]\cos\theta_0+\cos\nu\cos\beta\sin\theta_0\}$$

$$\{Y_L(X_4)=X_4-\cos\nu\sin\beta\sin\phi_X+\sin\nu\cos\phi_X\},$$

$$\{Z_L(X_4)=-X_4[\cos\nu\sin\beta\cos\phi_X+\sin\nu\sin\phi_X]\sin\theta_0+\cos\nu\cos\beta\cos\theta_0\}$$

$$\{X_L(Y_4)=Y_4[\sin\nu\sin\beta\cos\phi_X-\cos\nu\sin\phi_X]\cos\theta_0-\sin\nu\cos\beta\sin\theta_0\}$$

$$\{Y_L(Y_4)=Y_4\sin\nu\sin\beta\sin\phi_X+\cos\nu\cos\phi_X\},$$

$$\{Z_L(Y_4)=Y_4[\sin\nu\sin\beta\cos\phi_X-\cos\nu\sin\phi_X]\sin\theta_0+\sin\nu\cos\beta\cos\theta_0\}.$$

4. An N×N planar phased array antenna system comprising a grid of a plurality of $N^2$ antenna elements (20) disposed along a first and a second axis of a planar aperture and capable of providing wide angle coverage of a predetermined circular or elliptical orbital arc segment disposed around the earth and in the view of the antenna system at a ground station on the surface of the earth characterized in that the N×N planar phased array is oriented in a terrestrial surface coordinate system of the earth comprising a first, second and third axis ($X_1$, $Y_1$, $Z_1$) where the terrestrial surface coordinate system of the earth is a translation of a polar coordinate system of the earth comprising a first, second and third axes (X, Y, Z) of the earth, such that the orbital arc segment of interest lies in a plane substantially parallel to a cardinal plane in a directional cosine coordinate system of the antenna system; the antenna system comprising;

a plurality of $N^2$ fixed delay means (22), each fixed delay means being connected to a separate one of the plurality of $N^2$ antenna elements with each of the N corresponding fixed delay means disposed along a first direction of the grid of antenna elements providing a same predetermined phase delay to a signal propagating therethrough which phase delay is different than each of the phase delays provided by the corresponding N fixed delay means disposed along a second direction of the grid, which is orthogonal to said first direction, for producing a predetermined fixed linear phase taper to be applied along corresponding fixed delay means along said second direction of the grid and causing the antenna to launch an electromagnetic energy beam which is squinted by a predetermined amount toward the orbital arc segment of interest, a plurality of N phase shifting means (24), each of said phase shifting means being connected to a separate group of N corresponding phase delay means disposed along the second direction of the grid of antenna elements for introducing a predetermined linear phase taper to the associated antenna elements in response to a predetermined control signal for causing the electromagnetic energy beam to be directed at a predetermined point on the orbital arc segment and to redirect the beam along the orbital arc segment in response to the introduction of a different predetermined linear phase taper in response to a different predetermined control signal; and a phase shift controlling means (26) for generating the appropriate predetermined control signals to the plurality of N phase shifting means to appropriately direct the beam to any desired point on the orbital arc segment.

* * * * *